United States Patent [19]

Kanai

[11] Patent Number: 4,602,601

[45] Date of Patent: Jul. 29, 1986

[54] METHOD AND APPARATUS FOR CONTROLLING IDLING SPEED OF INTERNAL COMBUSTION ENGINE

[75] Inventor: Hiroshi Kanai, Toyota, Japan

[73] Assignee: Toyota Jidosha Kabushiki Kaisha, Toyota, Japan

[21] Appl. No.: 763,793

[22] Filed: Aug. 8, 1985

[30] Foreign Application Priority Data

Aug. 8, 1984 [JP] Japan ..... 59-164815

[51] Int. Cl.[4] ..... F02D 41/16

[52] U.S. Cl. ..... 123/339; 123/489; 123/589

[58] Field of Search ..... 123/339, 489, 589

[56] References Cited

U.S. PATENT DOCUMENTS

| | | | |
|---|---|---|---|
| 4,224,910 | 9/1980 | O'Brien | 123/489 |
| 4,240,390 | 12/1980 | Takeda | 123/440 |
| 4,501,240 | 2/1985 | Aono | 123/339 |
| 4,522,176 | 6/1985 | Takao et al. | 123/339 |

FOREIGN PATENT DOCUMENTS

| | | | |
|---|---|---|---|
| 59-63328 | 4/1984 | Japan | 123/489 |
| 59-168220 | 9/1984 | Japan . | |

*Primary Examiner*—Andrew M. Dolinar

*Attorney, Agent, or Firm*—Cushman, Darby & Cushman

[57] ABSTRACT

A method for controlling the rotational speed of an internal combustion engine in the idling state, including the steps of detecting an intake air flow rate in the engine and an air-fuel ratio of the engine and supplying the results of the decisions to a control circuit. The method includes the steps of generating output signals from the control circuit for generating the air flow rate and fuel injection amount, regulating the air flow rate while the engine is in an idling state, and regulating the fuel injection amount from a fuel injector in the engine. The method further includes the step of regulating the air flow rate while the engine is in an idling state and regulating the fuel injection amount from a fuel injector. The generation of the output signals from the control circuit is carried out by the steps of calculating an instruction output of the fuel injection amount, obtaining an air-fuel ratio closed-loop correction value, carrying out learning control for an air-fuel ratio learning correction value, deciding whether or not the engine is running under low atmospheric pressure on the basis of a comparison between the air fuel ratio learning correction value and a predetermined value, and changing the intake air flow rate for the idling state from the decision.

8 Claims, 3 Drawing Figures

CALCULATION OF TAU
START

100
IMMEDIATELY AFTER INVERSION OF O2 SENSOR OUTPUT ?
YES
NO
101
CHANGE FROM RICH TO LEAN ?
YES
NO
104
LEAN ?
YES
NO
105
FAF ← FAF+Ki
106
FAF ← FAF−Ki
103
FAF ← FAF−RS
102
FAF ← FAF+RS
CALCULATE TP
107
CALCULATE FEFI
108
TAU ← TP·FAF·FEFI·FGHAC
109
END

METHOD AND APPARATUS FOR CONTROLLING IDLING SPEED OF INTERNAL COMBUSTION ENGINE

BACKGROUND OF THE INVENTION

1. Field of the Invention

The present invention relates to a system for controlling idling speed of an internal combustion engine, more particularly to a system for controlling an idling speed enabling altitude compensation at high altitudes.

2. Description of the Related Art

In the prior art, there are already known various methods for controlling the rotational speed of an engine at an idle position of a throttle valve. In one method, the idle position of the throttle valve is controlled to regulate the intake air flow rate. In another, an air control valve is arranged in an intake path for bypassing the throttle valve and the air flow rate passing through the bypassed intake path is controlled by regulating the control valve. In this case, the position of the throttle valve or the afore-mentioned air control valve is regulated, in response to the difference between the desired rotational speed for control at the time of idle running and the actual rotational speed of the engine, to control the intake air flow rate. Thus, closed loop control is effected so that the rotational speed becomes equal to the desired rotational speed for controlling.

When the engine is run at a high altitude, the weight of the intake air decreases by an amount corresponding to the reduction in the intake air density. This causes a decline in the idling speed, causing, in the worse case, engine stalling.

In the prior art, there is provided for instance, a sensor for detecting the atmospheric pressure in the neighborhood of the engine. The idling intake air flow rate is connected in response to the output of the atmospheric pressure sensor. This prior art, however, requires not only an atmospheric pressure sensor, but also a circuit for processing the output of the atmospheric pressure. This means increased production costs and an increased number of terminals in the control circuit. Reference can be made to Japanese Unexamined Patent Publication (Kokai) No. 57-131841 which describes the connection of the intake air flow rate in the idling state in response to the output of an atmospheric pressure sensor.

SUMMARY OF THE INVENTION

It is an object of the present invention to control the idling speed with compensation for low-atmospheric pressures.

According to one aspect of the invention, the above object is achieved by a method including the steps of detecting an intake air flow rate in the engine; detecting an air-fuel ratio of the engine; detecting the rotation of a crankshaft of the engine; supplying the results of the detections of the intake air flow rate, air-fuel ratio, and rotation of crankshaft of the engine to a control circuit means; generating output signals from the control circuit means for regulating the air flow rate and fuel injection amount; regulating the air flow rate while the engine is in idling state on the basis of an output signal generated in the control circuit means; and regulating the fuel injection amount from a fuel injection in the engine. The output signals from the control circuit means are generated through the steps of: calculating an instruction output of the fuel injection amount; obtaining an air-fuel ratio closed-loop correction value; carrying out learning control for an air-fuel ratio learning correction value; deciding whether or not the engine is running under low atmosphere pressure on the basis of a comparison between the air-fuel ratio learning correction value and a predetermined value; and changing the intake air-flow rate for the idling state on the basis of the result of the decision.

According to another aspect of the invention, the above object is achieved by an apparatus including: means for detecting an intake air flow rate in the engine; means for detecting an air-fuel ratio of the engine; means for detecting the rotational speed of a crankshaft of the engine; means for regulating the intake air flow rate while the engine is in idling state; means for regulating the fuel injection amount from the fuel injector in the engine; and a control circuit means for receiving signals from the air flow rate detecting means, the air-fuel ratio detecting means, and the rotational speed detecting means and generating an output for regulating the air flow rate and an output for regulating the fuel injection amount. The control circuit has the functions of: calculating an instruction output of the fuel injection amount, based on the signals from the air flow rate detecting means, the air-fuel ratio detecting means, and the rotational speed detecting means; obtaining an air-fuel ratio closed-loop correction value; carrying out learning control for an air-fuel ratio learning correction value; deciding whether or not the engine is running under low atmospheric pressure on the basis of a comparison between the air-fuel ratio learning correction value and predetermined value; and changing the intake air flow rate for the idling state on the basis of the result of the decision.

In operation, it is discriminated whether the engine is operated at a high altitude by finding the air-fuel ratio learning correction value, then comparing the air-fuel ratio learning correction value with a predetermined value. When an engine is operated at a high altitude, the actual intake air flow rate (weight) is smaller than the apparent intake air flow rate detected by an air flow sensor. On account of this, the air-fuel ratio is controlled to the rich side. A closed loop control system acts to return the air-fuel ratio from the rich side to the lean side. Accordingly, learning is carried out in the direction of a small air-fuel ration learning correction amount. By comparing the learning correction value with the predetermined value, it can be discriminated whether or not the engine is operating at a high altitude.

DESCRIPTION OF THE PREFERRED EMBODIMENTS

Figure 1:
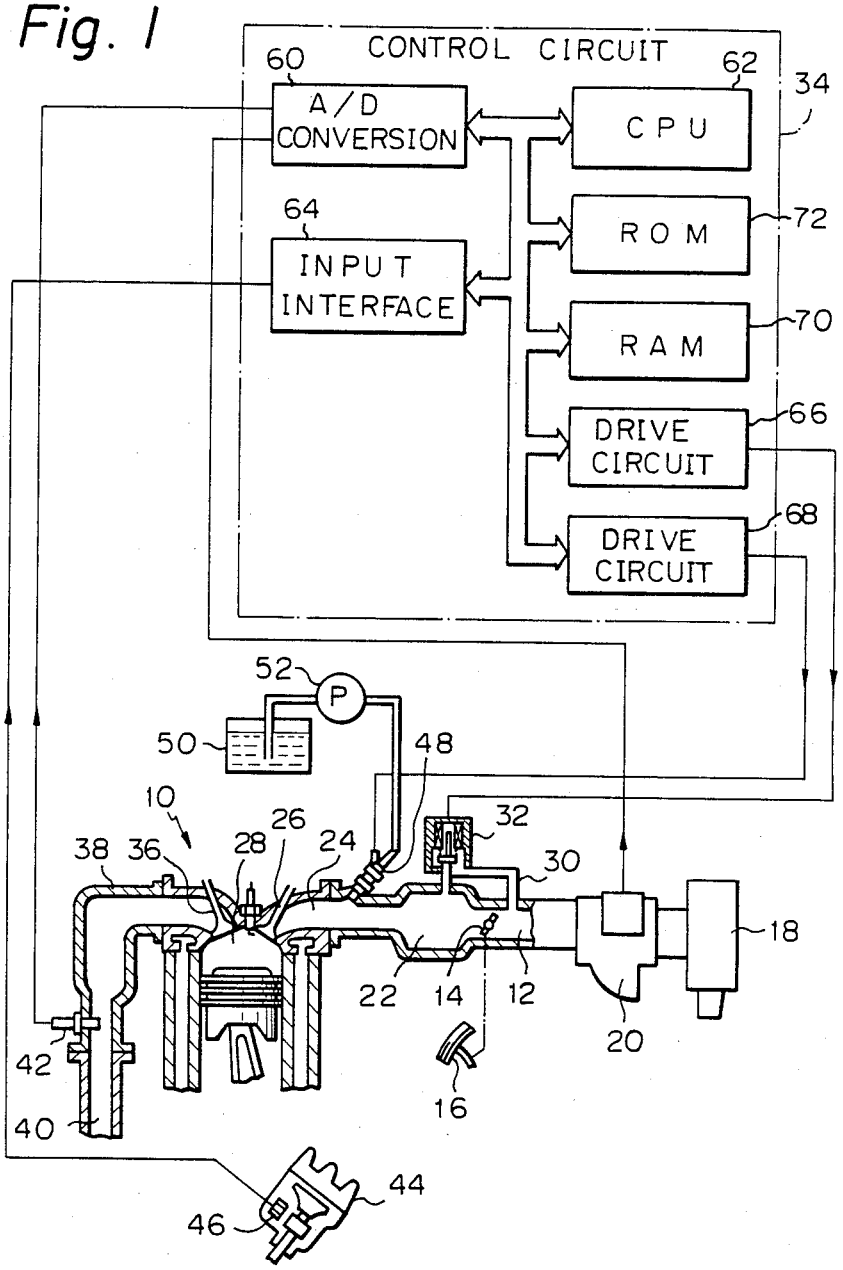
FIG. 1 is a schematic view of the general construction of an internal combustion engine provided with an electronic fuel injection system.

A detailed description will be given of an embodiment of the present invention with reference to the accompanying drawings. FIG. 1 shows an example of an electronic fuel injection internal combustion engine. In the figure, 10 denotes the engine body, 12 an intake path, and 14 a throttle valve mounted in the intake path. The throttle valve 14 is connected to an accelerator pedal 16.

Air sucked through an air cleaner 18 is delivered into a combustion chamber 28 via an intake passage 12 including an air flow sensor 20, a throttle valve 14, a surge tank 22, an intake port 24, and an air inlet valve 26. A bypass intake passage 30 is arranged in the intake passage 12 to bypass the throttle valve 14. In the bypassed intake passage 30 is arranged a solenoid valve 32 for control of the bypassed intake flow rate. The solenoid valve 32 operates in response to signals delivered from the control circuit 34.

Exhaust gas is discharged outward from a combustion chamber 28 through an exhaust valve 36, an exhaust manifold 38, and an exhaust pipe 40. In the exhaust manifold 38, there is provided a concentration sensor 42 for detecting the concentration of specific components in the exhaust gas, for instance, the concentration of oxygen, carbon dioxide, or carbon monoxide (in this example, $O_2$ sensor for detecting the concentration of oxygen). The output voltage signal produced from the $O_2$ sensor is sent to the control circuit 34.

A crank angle sensor 46 which produces a pulse every time the crankshaft rotates by a predetermined angle, for instance, 30 degrees, is arranged in a distributor 44. The pulse is sent to the control circuit 34.

In the same way, a voltage signal which represents the intake air flow rate is output from the air flow sensor 20 and sent to the control circuit 34.

Fuel injection valves 48 are arranged in the vicinity of an inlet port 24 for each cylinder. These open and close in response to drive signals provided from the control circuit 34 and intermittently inject fuel, which is pressure-supplied by the pump 52 from the fuel tank 50.

As is well known, in such electronic fuel injection internal combustion engines, the intake air flowing to the engine via the air cleaner 18 is detected by an air flow sensor 20, and the amount of fuel corresponding to the intake air flow rate is injected from the fuel injection valve 48 to supply mixed air to the combustion chamber 28. Accordingly, when the throttle valve 14 is at the idle position, control of the bypassed intake air flow rate by the solenoid valve 32 enables control of the rotational speed of the engine in response to the intake air flow rate.

The voltage signals from both the air flow sensor 20 and oxygen sensor 42 are sent into an analog-to-digital converter 60, which functions as an analog multiplexer, where they are selectively converted into binary signals in response to a selection signal delivered from a central processor unit 62.

One pulse per each 30 degrees of the crank angle is supplied from the crank angle sensor 46 to the central processor unit 62 through an input interface 64. This acts as both an interruption signal for each 30 degrees and is used in forming the positional signal for the reference crank angle with respect to the fuel injection and the like.

When a 1-bit injection pulse signal is output from the central processor unit 62 to the drive circuit 68, which signal has a duration equivalent to the injection pulse width TAU, the drive circuit 68 converts this pulse signal into a pulsating signal. The drive signal is delivered to the fuel injection valve 48 to energize the same, with the result that a fuel amount corresponding to the pulse width TAU is injected.

When a command signal for opening the solenoid valve 32 is output from the central processor unit 62 to the drive circuit 66, the output signal is converted into a drive signal by the drive circuit 66 and applied to the solenoid valve 32. As a result, the solenoid valve 32 opens and passes air through the bypass intake passage 30, raising the idling speed.

The analog-to-digital converter 60, input interface 64, drive circuits 66, 68 and central processor unit 62 are connected via a bus 74 to a random access memory (RAM) 70 and a read-only-memory (ROM) 72, other main constitutional elements of the microcomputer.

Many control programs, as described hereinafter, data for operation processing therefore, and tables are previously stored in the ROM 72.

The central processor unit 62 provides an instruction to the analog-to-digital convertor 60 for commencing analog-to-digital conversion every predetermined time. Therefore, the outputs of the air flow sensor 20 and the oxygen sensor 42 are analog-to-digital converted in sequence for storage in predetermined locations of the RAM 70.

Every time there is an interruption due to a 30 degree crank angle pulse from the crank angle sensor 46, the read value of the free-run counter counts the difference between the preceding value and the present value. This difference is equivalent to the time required for a 30 degree rotation of the crankshaft. The reciprocal value corresponds to the rotational speed of the engine. This derived rotational speed is stored in a predetermined location of the RAM 70.

Figure 2:
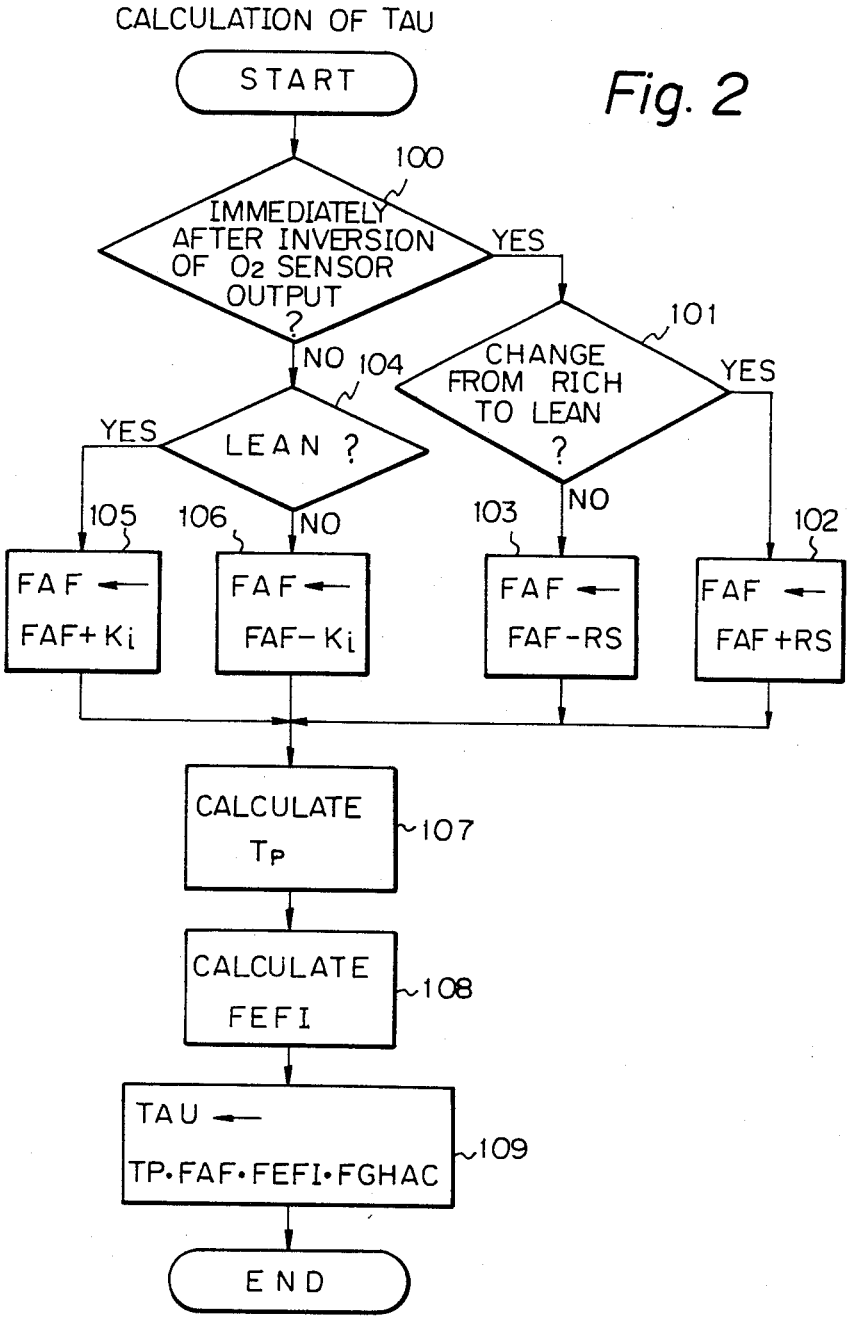
FIG. 2 is a flow chart of the control programs for computing the pulse width TAU for fuel injection.
Figure 3:
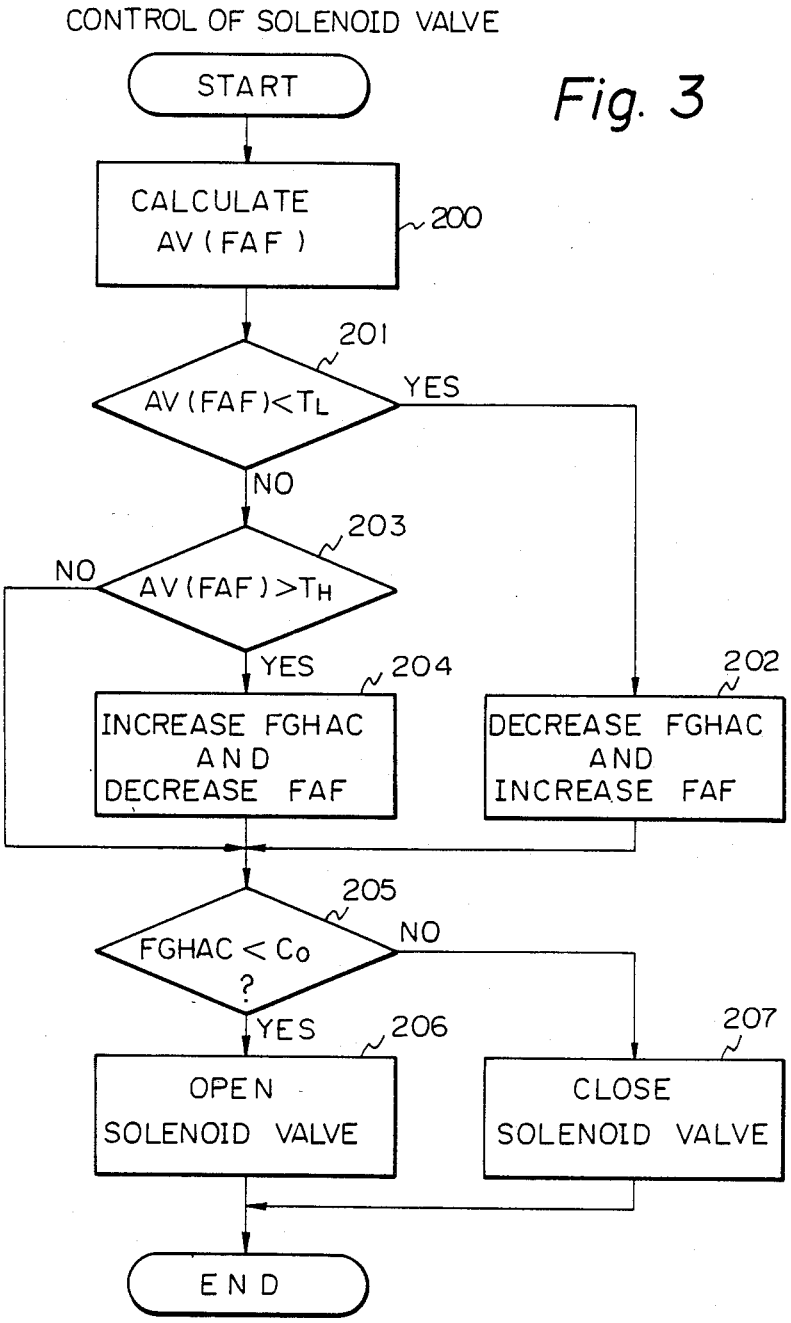
FIG. 3 is a flow chart of control programs for controlling the idling speed.

FIGS. 2 and 3 are flow charts for explaining the idling speed control and fuel injection control in accordance with the present invention.

FIG. 2 shows an example of a control program for calculating the fuel injection pulse width TAU. The central processor unit 62 carries out the processing in the course of a main routine or during an interruption routine every predetermined period.

At step 100, the output of the oxygen sensor 42 is used to discriminate whether or not a lean signal has just inverted to a rich signal or vice versa. The output of the oxygen sensor 42 is compared with the reference value either in the course of the processing routine in FIG. 2 or during a processing routine implemented at the completion of an analog-digital conversion. When larger than the reference value, it is given binary digits of a rich signal. When smaller, it is given binary digits of a lean signal.

If just after an inversion, the program proceeds to step 101, where it is discriminated whether or not the inversion is from rich to lean. When rich to lean, the program proceeds to step 102, where an air-fuel ratio closed-loop correction value FAF is increased by RS. When lean to rich, the program proceeds to step 103, where the air-fuel ratio closed-loop correction value FAF is decreased by RS. The processing method of steps 102 and 103 is designated as skip processing. When the output of oxygen sensor is inverted, the air-fuel ratio closed-loop correction value FAF is increased or decreased conversely to a drastic extent to improve the control function.

At step 100, when not just after an inversion, the program proceeds to step 104, where the output of the oxygen sensor 42 is used to discriminate whether the air-fuel ratio is rich or lean. When lean, the program proceeds to step 105, where the FAF is increased by an amount $K_i$ ($K_i << RS$). When rich, the program proceeds to step 106, where the FAF is decreased by the amount $K_i$. Accordingly, when lean, the FAF increases gradually by the amount $K_i$, while when rich, the FAF decreases gradually by the amount $K_i$. Thus, the steps 105 and 106 integrate FAF corresponding to the output of the oxygen sensor 42. When lean, the FAF is integrated in the increasing direction. When rich, the FAF is integrated in the decreasing direction.

At the next step 107, a fundamental injection pulse width TP is obtained by a well known method from the intake air flow rate and rotational speed. At the succeeding step 108, various correction increments of the fuel injection amount, for instance, a warming-up increment and an acceleration increment, are added and subtracted to obtain a correction amount FEFI. At the next step 109, the resulting injection pulse width TAU is obtained by the following equation from the basic injection pulse width TP, air-fuel ratio closed-loop correction amount FAF, correction amount FEFI, and air-fuel ratio learning correction amount FGHAC derived from the processing routine in FIG. 3:

$$TAU = TP \cdot FAF \cdot FEFI \cdot FGHAC$$

Various methods are known for forming an injection pulse signal having a duration corresponding to TAU from an injection pulse width TAU calculated in this way. In one method, when an injection start timing signal is generated, the injection pulse signal is inverted to "1" and the value of the free-run counter at that time determined. The counter value after the time TAU is preset in a comparison register. When the value of the free-run counter becomes equal to the preset value of the comparison register, an interruption is generated and the injection pulse signal inverted to "0", thereby forming an injection pulse signal having a duration corresponding to TAU.

FIG. 3 shows a program for controlling the idling speed. At step 200, the central processor unit CPU 62 calculates the average valve AV(FAF) of the air-fuel ratio closed-loop correction value FAF in a specified period. At the next step 201, it is discriminated whether or not the average value AV(FAF) is smaller than the lower limit $T_L$. When $AV(FAF) < T_L$, the base air-fuel ratio (that is, the air-fuel ratio before it is connected by closed-loop control) is too rich, so the program proceeds to step 202, where the air-fuel ratio learning connection quantity FGHAC is reduced and FAF increased. The increase of FAF is for the purpose of raising the speed of the air-fuel ratio control over the closed-loop integration control.

When the average value AV(FAF) is over the lower limit $T_L$, the program proceeds to step 203, where it is discriminated whether or not AV(FAF) is larger than the upper limit $T_H$. When $AV(FAF) > T_H$, the base air-fuel ratio is too lean, so the program proceeds to step 204, where the air-fuel ratio learning correction amount FGHAC is increased and the air-fuel ratio closed-loop correction value FAF is reduced.

At step 203, when AV(FAF) is under the upper limit $T_H$, the expression $T_L \leqq AV(FAF) \leqq T_H$ holds, and the base air-fuel ratio is in the allowable region, so learning of FGHAC is not carried out and the program proceeds directly to step 205.

At step 205, the learning correction value is compared with a previously specified predetermined value $C_0$. When $FGHAC < C_0$, it is discriminated that the engine is operated at a high altitude, i.e., a place of low atmospheric pressure. The program then proceeds to step 206, where a command signal is issued for opening the solenoid valve 32. When $FGHAC \geqq C_0$, the program proceeds to step 207, where a command is issued for closing the solenoid valve 32.

As described before, when the solenoid valve 32 opens, the intake air flow rate increases due to the air flowing through the bypass intake passage 30, thereby preventing a decrease of the idling speed at high altitudes. This prevents engine stalling.

In the example described above, the learning correction value FGHAC is compared with one predetermined value $C_0$ in order to discriminate whether or not the engine is operating at a high altitude.

By using a different predetermined value when the FGHAC decreases and when it increases, comparison and discrimination having hysteresis characteristics are possible.

Further, when judged to be operating at a high altitude, it is possible not to simply turn the solenoid on, but also to perform other processing to increase the air flow rate in the bypass intake passage, for instance, to increase the opening of the air control valve. Further, it is possible not to operate the bypassed intake passage valve, but to just slightly open the throttle valve from its closed position so as to increase the idling intake air flow rate.

What is claimed is:

1. A method for controlling the rotational speed of an internal combustion engine in the idling state comprising the steps of:

detecting an intake air flow rate in the engine;

detecting an air-fuel ratio of the engine;

detecting the rotation of a crankshaft of the engine;

supplying the results of said detections of the intake air flow rate, the air-fuel ratio, and the rotation of the crankshaft to a control circuit means;

generating output signals from said control circuit means for regulating the air flow rate and fuel injection amount;

regulating the air flow rate while the engine is in an idling state on the basis of an output signal generated in said control circuit means; and regulating the fuel injection amount from a fuel injection in the engine;

said generation of said output signals from said control circuit means being carried out by the steps of:

calculating an instruction output of the fuel injection amount;

obtaining an air-fuel ratio closed-loop correction value;

carrying out learning control for an air-fuel ratio learning correction value;

deciding whether or not the engine is running under low atmospheric pressure on the basis of a comparison between said air-fuel ratio learning correction value and a predetermined value; and changing the intake air flow rate for the idling state on the basis of the results of said decision.

2. A method according to claim 1, wherein said learning control for an air-fuel ratio learning correction value includes a calculation of the average value of the air-fuel ratio closed-loop correction values during a predetermined period.

3. A method according to claim 2, wherein said learning control is carried out by the change of an air-fuel ratio learning correction value and change of an air-fuel ratio closed-loop correction value on the basis of the results of decisions whether or not the calculated average value of the air-fuel ratio closed-loop correction value is lower than a predetermined lower limit value and whether or not the calculated average value of the air-fuel ratio closed-loop correction value is higher than a predetermined upper limit value.

4. A method according to claim 1, wherein said regulation of the intake air flow rate is carried out by changing the opening of a solenoid valve arranged in a passage bypassing a throttle valve of the engine.

5. An apparatus for controlling the rotational speed of an internal combustion engine in the idling state comprising:

means for detecting an intake air flow rate in the engine;

means for detecting an air-fuel ratio of the engine;

means for detecting the rotational speed of a crankshaft of the engine;

means for regulating the intake air flow rate while the engine is in the idling state;

means for regulating the fuel injection amount from the fuel injector in the engine; and control circuit means for receiving signals from said air flow rate detecting means, said air-fuel ratio detecting means, and said rotational speed detecting means and generating an output for regulating the air flow rate and an output for regulating the fuel injection amount;

said control circuit means having the functions of:

calculating an instruction output of the fuel injection amount, based upon the signals from said air flow rate detecting means, said air-fuel ratio detecting means, and said rotational speed detecting means;

obtaining an air-fuel ratio closed-loop correction value;

carrying out learning control for an air-fuel ratio learning correction value;

deciding whether or not the engine is running under low atmospheric pressure on the basis of a comparison between said air-fuel ratio learning correction value and a predetermined value; and changing the intake air flow rate for the idling state on the basis of the result of said decision.

6. An apparatus according to claim 5, wherein said function of obtaining an air-fuel ratio closed-loop correction value includes a function of calculating the average value of the air-fuel ratio closed-loop correction value during a predetermined period.

7. An apparatus according to claim 6, wherein said function of learning control includes functions of changing an air-fuel ratio learning correction value and changing an air-fuel ratio closed-loop correction value on the basis of the results of decisions whether or not the calculated average value of the air-fuel ratio closed-loop correction value is lower than a predetermined lower limit value and whether or not the calculated average value of the air-fuel ratio closed-loop correction value is higher than a predetermined upper limit value.

8. An apparatus according to claim 5, wherein said intake air flow rate regulating means is a solenoid valve arranged in a passage bypassing a throttle valve of the engine.

* * * * *